United States Patent [19]

Kaman, II

[11] 4,119,009

[45] Oct. 10, 1978

[54] STRINGED INSTRUMENT NECK WITH PEGHEAD

[75] Inventor: Charles William Kaman, II, East Killingly, Conn.

[73] Assignee: Kaman Aerospace Corporation, Bloomfield, Conn.

[21] Appl. No.: 855,798

[22] Filed: Nov. 29, 1977

[51] Int. Cl.[2] ..... G10D 3/14; G10D 1/08

[52] U.S. Cl. ..... 84/293

[58] Field of Search ..... 84/293, 267, 297 R, 84/304, 306, 454

[56] References Cited

U.S. PATENT DOCUMENTS

| | | | |
|---|---|---|---|
| 2,597,154 | 5/1952 | Maccaferri | 84/267 |
| 2,795,988 | 6/1957 | Maccaferri | 84/293 |
| 3,911,778 | 10/1975 | Martin | 84/267 |

*Primary Examiner*—L. T. Hix
*Assistant Examiner*—S. D. Schreyer
*Attorney, Agent, or Firm*—McCormick, Paulding & Huber

[57] ABSTRACT

A neck for a stringed musical instrument has a metallic frame running substantially the entire length of the neck to provide a fingerboard and also to provide support for a peghead at the outer or upper end of the neck. The peghead portion of the frame cooperates with a mounting plate which may be varied in shape to suit different peghead styles and arrangements of the machine heads attached to the peghead, thereby allowing identical frames to be used in making necks with various different peghead designs. In addition to the frame, a major portion of the neck is comprised of structural foamed plastic with the construction being such as to enable quantity manufacture of the necks at low unit cost.

8 Claims, 14 Drawing Figures

Fig. 1
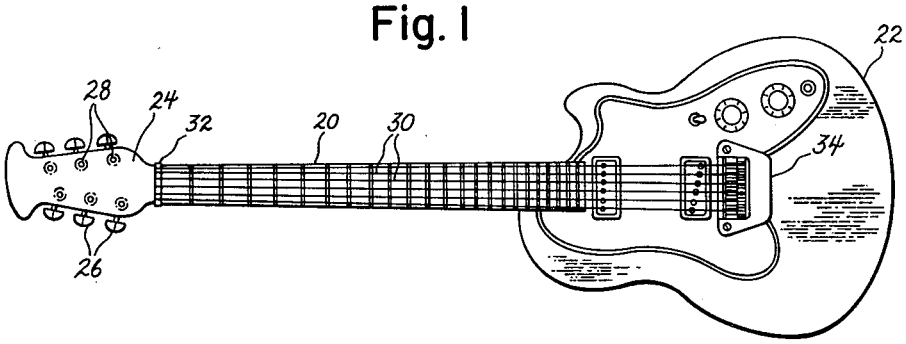
Fig. 2
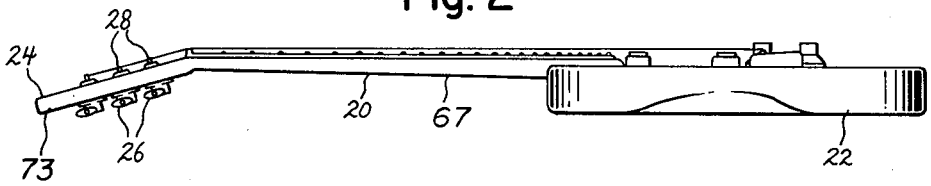
Fig. 3
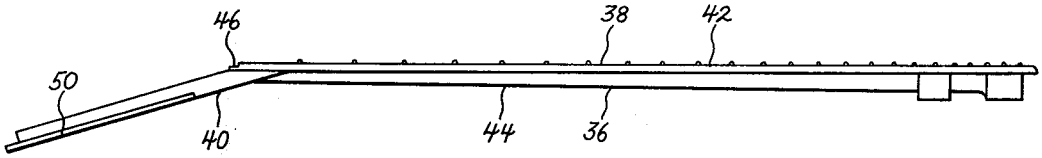
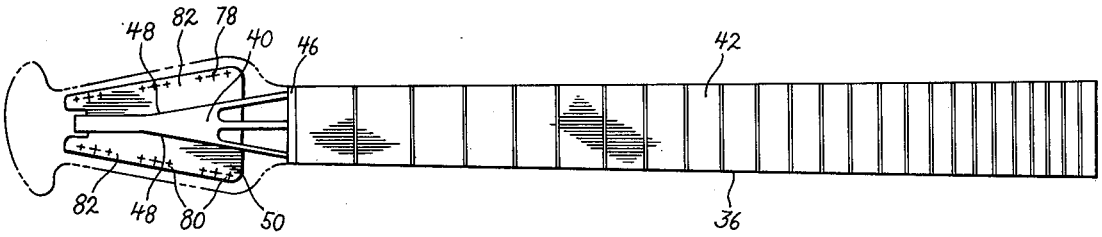
Fig. 4

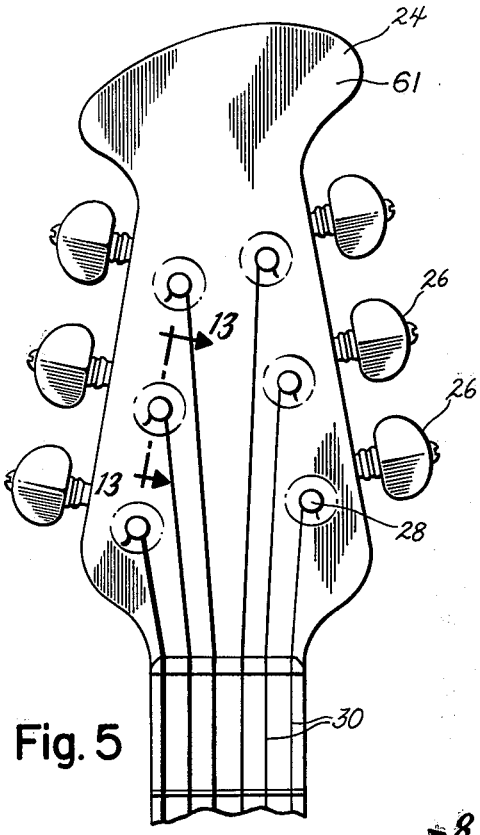
Fig. 5
Fig. 7
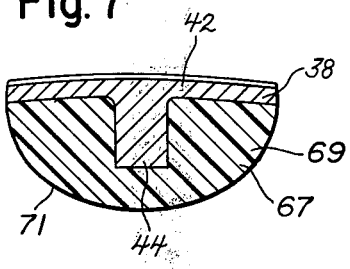
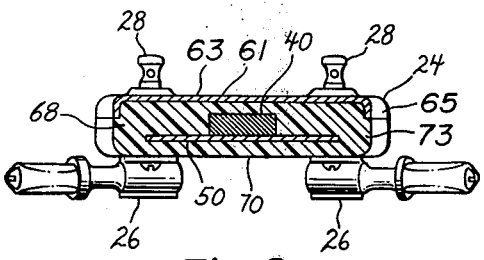
Fig. 8
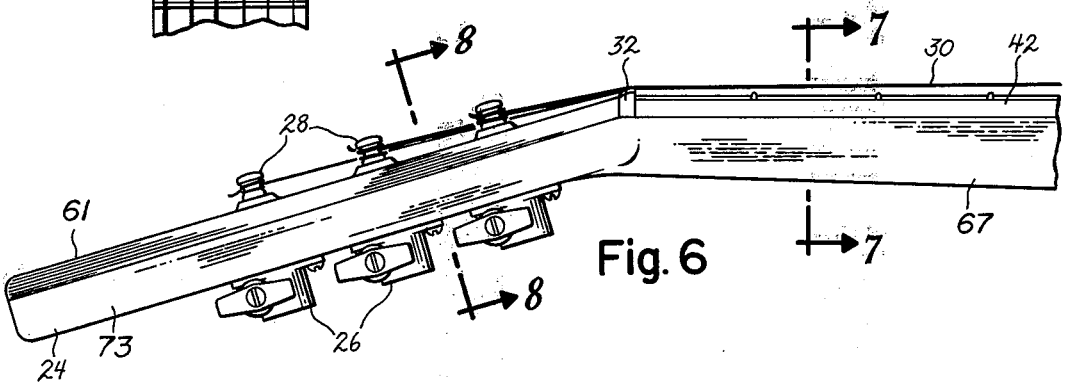
Fig. 6
Fig. 9
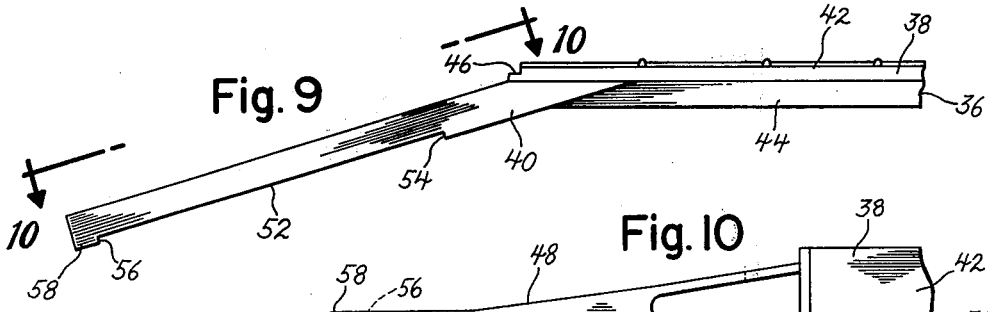
Fig. 10
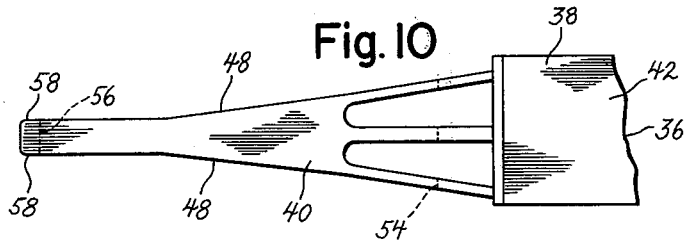

Fig. 11
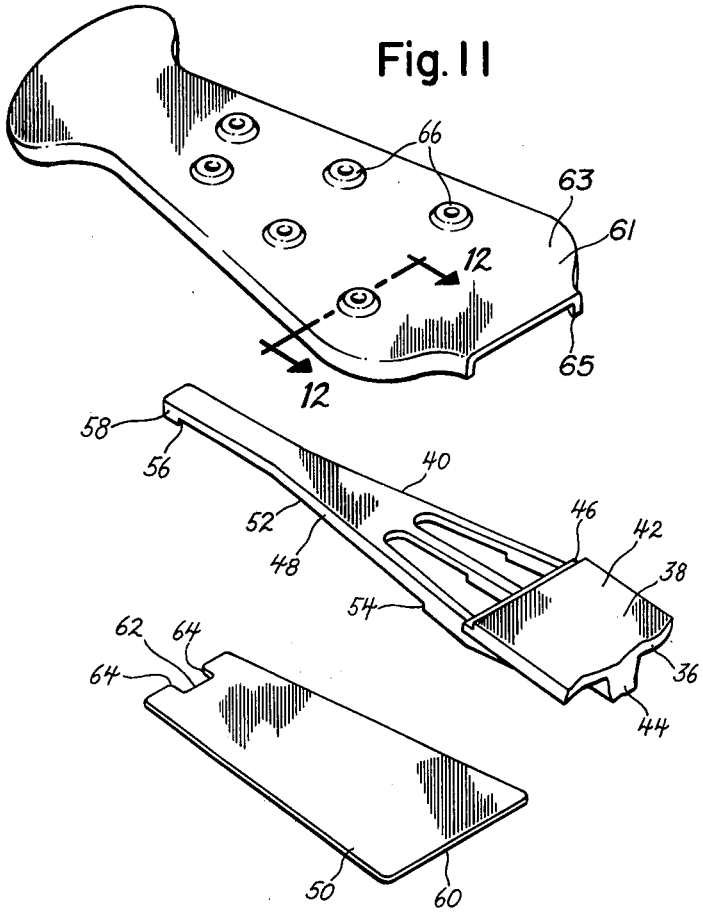
Fig. 12
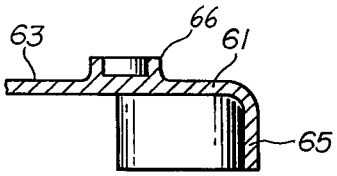
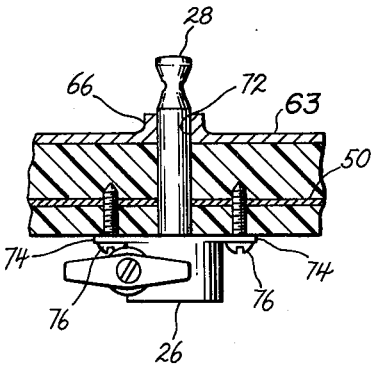
Fig. 13
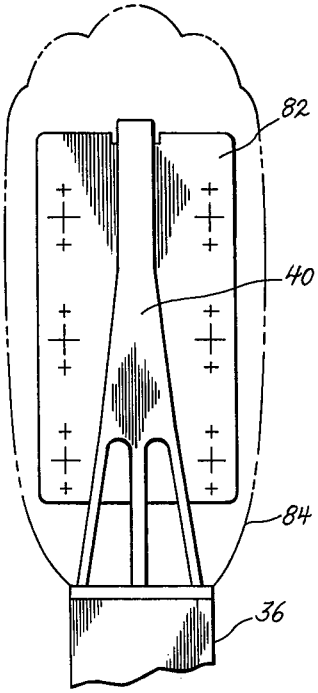
Fig. 14

STRINGED INSTRUMENT NECK WITH PEGHEAD

BACKGROUND OF THE INVENTION

This invention relates to a neck for a stringed musical instrument made principally of a metallic frame and a mass of structural foamed plastic, and deals more particularly with improvements in the construction of the peghead portion of such a neck.

As shown in U.S. Pat. No. 3,911,778, it is known to make a neck for a guitar or other stringed musical instrument of a metallic frame combined with structural foamed plastic. As shown in that patent, the frame is a die cast member having at its outer end a portion defining the external shape of the peghead; and, therefore, to obtain necks with different shapes or designs of pegheads it is necessary to provide correspondingly different frames.

Very often, stringed instrument manufacturers make many different models of an instrument with the various models having pegheads of different sizes or shapes or adapted to carry different numbers or arrangements of machine heads to which the outer ends of the strings are attached. Except for these differences in the pegheads, the necks may be otherwise generally similar from model to model.

The general object of this invention is, therefore, to provide a neck for a stringed musical instrument, made largely of a metallic frame and a mass of structural foamed plastic, wherein the shape, size and other features of the peghead may be varied while using the same basic design of frame, thereby avoiding the necessity for providing a different style frame for each different style peghead.

A further object of the invention is to provide a metallic frame and foamed plastic stringed instrument neck construction which is of a sturdy, low cost construction, particularly in the area of the peghead, and other objects and advantages of the invention will be apparent from the following description and from the drawings forming a part hereof.

SUMMARY OF THE INVENTION

This invention resides in a neck for a stringed musical instrument comprised of a one-piece metallic neck frame having an elongated fingerboard section with upper and lower ends and a peghead section extending generally upwardly from the upper end of the fingerboard section. The peghead section cooperates with a mounting plate located behind it and having wings extending laterally beyond either side of it. A mass of structural foamed plastic surrounds the peghead frame section and the mounting plate and a plurality of machine heads are attached to the peghead. Each of these machine heads has a spindle which passes through the mass of structural foamed plastic and one of the wing portions of the mounting plate and it also includes at least one mounting flange accommodating a screw which is fastened to the peghead by being threadably engaged with one of the wing portions of the mounting plate. The mounting plate, therefore, anchors the machine heads to itself and it in turn is anchored by the peghead frame section against which it is drawn by the force of the strings pulling on the machine head spindles.

The invention further resides in the mounting plate being vertically and laterally located relative to the peghead frame section by co-engaging surfaces on the mounting plate and the frame section.

BRIEF DESCRIPTION OF THE DRAWINGS

FIG. 1 is a front view of a guitar having a neck embodying the present invention.

FIG. 2 is a side elevational view of the guitar of FIG. 1.

FIG. 3 is a side elevational view of the frame and mounting plate used in the neck of the guitar of FIGS. 1 and 2.

FIG. 4 is a front view of the frame and mounting plate of FIG. 3.

FIG. 5 is an enlarged front view of the peghead of the guitar of FIG. 1.

FIG. 6 is a side elevational view of the peghead of FIG. 5.

FIG. 7 is a transverse sectional view taken on the line 7—7 of FIG. 6.

FIG. 8 is a transverse sectional view taken on the line 8—8 of FIG. 6.

FIG. 9 is an enlarged side elevational view of the peghead section of the frame as shown in FIG. 3.

FIG. 10 is a front view of the peghead section of the frame as taken on the line 10—10 of FIG. 9.

FIG. 11 is an exploded perspective view showing in more detail the construction and arrangement of the mounting plate, frame and cap member used in the peghead of FIG. 5.

FIG. 12 is a fragmentary sectional view taken through the cap member on line 12—12 of FIG. 11.

FIG. 13 is a fragmentary sectional view taken on the line 13—13 of FIG. 5.

FIG. 14 is a view similar to the left hand portion of FIG. 4 but showing the frame in combination with a different mounting plate to suit a different design of peghead.

DETAILED DESCRIPTION OF THE PREFERRED EMBODIMENTS

Considering first FIGS. 1 and 2, a guitar is shown by these figures to include a neck 20 and a body 22. The neck 20, which embodies the invention is hereinafter described in more detail, has at its outer end a peghead 24 carrying a plurality of machine heads 26, 26 having posts or spindles 28, 28 to which the outer ends of the strings 30, 30 are individually attached. From these spindles, the strings pass over a nut 32 to a bridge 34 carried by the body 22. In the remainder of the description and the claims which follow, the relative terms "upper", "lower", "forward", and "rear", and their derivatives, are used with it being assumed that the instrument in question is oriented with its peghead uppermost and with its strings facing the viewer. Thus, the neck 20 can be said to extend upwardly from the upper end of the body 22 and FIG. 1 shows the forward surface of the body and the neck.

The construction of the body 22 and of the joint between the neck and the body do not by themselves form any part of the invention and may take various different forms without departing from the invention.

In accordance with the invention, the neck 20 is comprised of a one piece metallic frame or skeleton and a mass of structural foamed plastic which provides most of the substance of the remainder of the neck. The neck frame is shown fully at 36 in FIGS. 3 and 4. Referring to these figures, the frame 36 is comprised of a fingerboard section 38 and a peghead section 40 extending generally upwardly and rearwardly from the upper end of the fingerboard section. The fingerboard section in turn includes a broad forward portion 42 providing a fretted fingerboard and a rear elongated rib 44. At the upper end of the broad or fingerboard portion 42 is a rabbet 46 for receiving the nut 32. The peghead section 40 has two side surfaces 48, 48 and, as seen from the front as in FIG. 4, tapers from a relatively wide dimension adjacent the rabbet 46 to a relatively narrow dimension adjacent its outer or upper end.

In the peghead 24, the peghead frame section 40 cooperates with a mounting plate such as shown at 50 in FIGS. 3, 4, 8, 11 and 13. This plate is located behind the peghead frame section 40 and is preferably made of sheet metal. To accommodate and locate the mounting plate the peghead frame section 40, as best seen in FIGS. 9 and 10, has a flattened bearing surface 52, an upwardly facing abutment surface 54 at the lower end of the bearing surface 52, and a downwardly facing abutment surface 56 at the upper end of the bearing surface 52. The peghead frame section extends upwardly for some distance beyond the downwardly facing abutment surface 56 and provides two side surfaces 58, 58 which are part of the side surfaces 48, 48. The mounting plate 50, in turn, has a lower end edge 60, an upper end edge 62, and two side edges 64, 64 which extend upwardly from the upper end edge 62. As shown in FIGS. 3 and 4, the mounting plate 50 is of such a size and shape as to bear flatly against the bearing surface 52, as to be located vertically relative to the peghead frame section 40 by co-engagement of the abutment surfaces 54 and 56 with the end surfaces 60 and 62, and as to be located laterally by engagement of the side surfaces 58, 58 of the frame with the side surfaces 64, 64 of the mounting plate.

The peghead 24 of the neck also includes a plastic cap member 61 defining its front surface and part of its side surface. This cap member is preferably made of a molded plastic and as shown in FIGS. 8, 11 and 12, it includes a forward wall 63 and a side wall 65 extending rearwardly from the periphery of the forward wall and extending along the entire length of said periphery except for being omitted at the lower end of the member which is located adjacent the nut 32 in the finished neck. The forward wall 63 includes a plurality of bosses 66, 66 each associated with a respective one of the spindles 28, 28 of the machine heads 26, 26.

As shown in FIGS. 2 and 7, along the length of the fingerboard section 38 of the neck frame is a mass 67 of structural foamed plastic having a foamed interior 69 and a solid outer skin 71 providing a curved rear surface for the neck. Likewise, as shown in FIG. 8, the peghead 24 includes a mass 73 of structural foamed plastic having a foamed interior 68 and a solid skin 70 defining the rear surface of the peghead as well as the rear part of the side edge of the peghead, the remainder of the external surface of the peghead being defined by the cap member 60.

The mass 67 of plastic associated with the fingerboard section of the frame and the mass 73 associated with the peghead section of the frame are integral with one another and are foamed in place relative to other parts of the neck as follows. That is, in the making of the neck a neck frame 36 is assembled with a mounting plate, such as the mounting plate 50, and placed in a mold together with a peghead cap member 61. The attachment of the mounting plate to the frame need only be sufficient to hold the mounting plate in place relative to the frame during the foaming process and, therefore, may consist simply of a small amount of adhesive between the mounting plate and the frame. After placing this assembly and the cap member into the mold, a mixture of unfoamed plastic and foaming agent is introduced to the mold and is allowed to foam and cure. During this foaming, the plastic surrounds the rib member 44 of the fingerboard section as shown in FIG. 7 and also surrounds the mounting plate and peghead section of the frame as shown in FIG. 8. Through contact with the surface of the mold it also forms the solid skin 71 of the fingerboard portion of the neck and the solid rear skin 70 of the peghead portion of the neck and it also adheres to the rear surface of the cap member 61 to hold the cap member, mounting plate 50 and peghead section 40 of the frame in assembly with one another.

The cap member 61, as seen best in FIG. 12, is initially made with each of its bosses being unapertured and the mounting plate 50 is also initially unapertured. No apertures are made in these parts until after the foaming and curing step.

After the foaming and curing of the plastic masses 67 and 73 the neck is taken from the mold and holes are drilled through the peghead to accommodate the spindles 28, 28 of the machine heads 26, 26. One such hole is indicated at 72 in FIG. 13 from which it will be noted that it is located to pass through the center of one boss 66 and is of a size closely conforming to the diameter of the spindle 28. Therefore, the material of the cap member 62 serves in part to form a bearing for the forward portion of the spindle.

As illustrated in FIG. 13, each machine head 26 has two mounting flanges 74, 74 each located adjacent the rear surface of the peghead and each receives a mounting screw 76 for holding the machine head to the peghead. To securely anchor the machine head to the peghead, each screw 76 passes through part of the foamed plastic and is threadably received by the mounting plate 50. To allow for this, suitable blind openings are drilled into the rear surface of the peghead and through the mounting plate before the screws are introduced. In FIG. 4, the large crosses indicated at 78, 78 represent the openings which are subsequently drilled through the mounting plate to accommodate the spindles 28, 28 and the small crosses 80, 80 represent the holes eventually drilled through the mounting plate to accommodate the mounting screws 76, 76. It will be observed that all of these openings are located in one of two wing portions of the mounting plate located on opposite sides of the peghead frame section 40. Each of these wing portions is indicated at 82, 82 in FIG. 4 and is located outboard of one of the side surfaces 48, 48 of the frame section 40.

An advantage of the peghead construction described above is that mounting plates of different shapes may be substituted for the illustrated mounting plate 50 and may be combined with identical frames 36 to make necks having pegheads with shapes different from that shown in FIGS. 1 and 5. For example, FIG. 14 shows a mounting plate 82 which is used with a frame 36 to allow the manufacture of a neck having a peghead shape such as shown by the phantom line 84.

I claim:

1. A neck for a stringed musical instrument, said neck comprising: a one-piece metallic neck frame having an elongated fingerboard section with upper and lower ends and a peghead section extending generally upwardly from said upper end of said fingerboard section and having two generally upwardly extending sides, a mounting plate located behind said peghead frame section, said mounting plate being engaged with said peghead frame section and having two wing portions respectively extending laterally beyond said two sides of said peghead frame section, a mass of structural foamed plastic surrounding said peghead frame section and said mounting plate, a plurality of machine heads each having a spindle extending through said mass of structural foamed plastic and one of said wing portion of said mounting plate, each of said machine heads further having at least one mounting flange, and a mounting screw associated with each of said mounting flanges, said mounting screw passing through said flange and through part of said mass of structural foamed plastic and being threadably engaged with an associated one of said wing portions of said mounting plate.

2. A neck for a stringed musical instrument as defined in claim 1 further characterized by said peghead frame section, said mounting plate and said mass of structural foamed plastic being part of a peghead, said mass of structural foamed plastic having a rigid external skin defining the external rear surface of said peghead, and said mounting flanges of said machine heads being located adjacent said rear surface of said peghead.

3. A neck for a stringed musical instrument as defined in claim 2 further characterized by said peghead also including a cap member defining the forward surface of said peghead, said cap member having a forward wall defining the forward surface of said peghead and a side wall extending rearwardly from the periphery of said forward wall along the major portion of the extent of said periphery.

4. A neck for a stringed musical instrument as defined in claim 3 further characterized by said cap member being made of a molded plastic material.

5. A neck for a stringed musical instrument as defined in claim 4 further characterized by said cap member, said peghead section of said neck frame and said mounting plate being held in assembly with one another by said mass of structural foamed plastic.

6. A neck for a stringed musical instrument as defined in claim 3 further characterized by said cap member having a plurality of bosses through each of which bosses the spindle of one of said machine heads extends, each of said bosses having an opening closely conforming to the outside diameter of the associated spindle so as to serve as a bearing for said spindle.

7. A neck for a stringed musical instrument as defined in claim 1 further characterized by said elongated fingerboard portion of said neck having a broad forward portion providing a fingerboard and a rearwardly extending rib, and a mass of structural foamed plastic located behind said board forward portion and surrounding said rib and having a curved rear surface defining a rear surface for said neck between said peghead and the lower end of said neck, said mass of foamed plastic associated with said peghead section of said neck frame and said mass of foamed plastic associated with said fingerboard section of said neck frame being integral with one another.

8. A neck for a stringed musical instrument as defined in claim 1 further characterized by said peghead section of said neck frame having a rearwardly facing flat bearing surface for engagement with said mounting plate, an upwardly facing abutment surface at the lower end of said bearing surface, a downwardly facing abutment surface at the upper end of said bearing surface and two side surfaces extending upwardly from said downwardly facing abutment surface, said mounting plate having a lower edge surface engageable with said upwardly facing abutment surface and an upper edge surface engageable with said downwardly facing abutment surface to vertically locate said mounting plate relative to said peghead frame section and said mounting plate also having, adjacent said upper edge surface, two upwardly extending side surfaces engageable with said side surfaces of said peghead frame section to laterally locate said mounting plate relative to said peghead frame section.

* * * * *